US010051892B2

(12) United States Patent
Rogan et al.

(10) Patent No.: US 10,051,892 B2
(45) Date of Patent: Aug. 21, 2018

(54) AEROSOL TRANSFERRING ADAPTER FOR AN AEROSOL GENERATING DEVICE AND METHOD FOR TRANSFERRING AEROSOL WITHIN AN AEROSOL GENERATING DEVICE

(71) Applicant: JT International S.A., Geneva (CH)

(72) Inventors: Andrew Robert John Rogan, Central Scotland (GB); Arlene Deborah Smith, Antrim (GB)

(73) Assignee: JT International S.A. (CH)

( * ) Notice: Subject to any disclaimer, the term of this patent is extended or adjusted under 35 U.S.C. 154(b) by 63 days.

(21) Appl. No.: 15/028,107

(22) PCT Filed: Oct. 7, 2014

(86) PCT No.: PCT/EP2014/071453

§ 371 (c)(1),
(2) Date: Apr. 8, 2016

(87) PCT Pub. No.: WO2015/052192

PCT Pub. Date: Apr. 16, 2015

(65) Prior Publication Data

US 2016/0235121 A1 Aug. 18, 2016

(30) Foreign Application Priority Data

Oct. 8, 2013 (EP) ..... 13187706

(51) Int. Cl.
*A24F 47/00* (2006.01)
*A24D 3/04* (2006.01)
(Continued)

(52) U.S. Cl.
CPC ..... *A24F 47/008* (2013.01); *A24D 3/041* (2013.01); *A24F 7/00* (2013.01); *H05B 1/0227* (2013.01); *H05B 3/0014* (2013.01)

(58) Field of Classification Search
CPC ..... A24F 13/06; A24F 47/008; A24F 7/00
(Continued)

(56) References Cited

U.S. PATENT DOCUMENTS 2,124,130 A 7/1938 Van Deventer
4,848,375 A 7/1989 Patron et al.
(Continued)

FOREIGN PATENT DOCUMENTS

EP 0317154 A1 5/1989
EP 0317154 B1 * 3/1993 ..... A24D 3/041
(Continued)

OTHER PUBLICATIONS

International Search Report dated Feb. 3, 2015 issued in corresponding PCT/EP2014/071453 application (pp. 1-4).
(Continued)

*Primary Examiner* — Abdullah Riyami
*Assistant Examiner* — Nader Alhawamdeh
(74) *Attorney, Agent, or Firm* — Lerner, David, Littenberg, Krumholz & Mentlik, LLP

(57) ABSTRACT

The present invention pertains to an aerosol transferring adapter for an aerosol generating device, comprising a liquid storage component and a mouthpiece. The liquid storage component comprises a liquid reservoir for holding a liquid used to generate an aerosol, an airflow channel leading through the liquid reservoir, and a connector fitting arranged around the airflow channel. The mouthpiece comprises at least two mouthpiece compartments being fluidly separated from each other and each leading from at least one mouthpiece inlet to at least one mouthpiece outlet, and a mouthpiece fitting arranged around the mouthpiece inlet and configured to be alignably connected to the connector fitting of the liquid storage component.

15 Claims, 2 Drawing Sheets

(51) Int. Cl.
*A24F 7/00* (2006.01)
*H05B 1/02* (2006.01)
*H05B 3/00* (2006.01)

(58) Field of Classification Search
USPC ..... 131/328, 187
See application file for complete search history.

(56) References Cited

U.S. PATENT DOCUMENTS 9,408,416 B2 * 8/2016 Monsees ..... A61M 15/06
2004/0003864 A1 * 1/2004 Bloome ..... B65D 83/42 141/20
2004/0237974 A1 * 12/2004 Min ..... A24D 3/045 131/187
2013/0008457 A1 * 1/2013 Zheng ..... A24B 15/24 131/297
2013/0160764 A1 6/2013 Liu
2013/0192615 A1 * 8/2013 Tucker ..... H01C 17/00 131/328
2013/0213418 A1 * 8/2013 Tucker ..... A24F 47/008 131/328
2014/0209105 A1 * 7/2014 Sears ..... F22B 1/28 131/328
2014/0238421 A1 * 8/2014 Shapiro ..... A24F 47/008 131/328
2014/0261486 A1 * 9/2014 Potter ..... A24F 47/008 131/328
2014/0353856 A1 12/2014 Dubief
2015/0122277 A1 * 5/2015 Frobisher ..... A24D 3/04 131/329
2015/0128969 A1 * 5/2015 Chapman ..... A24F 47/008 131/329
2016/0007649 A1 * 1/2016 Sampson ..... A24F 7/02 131/187
2016/0235121 A1 * 8/2016 Rogan ..... A24D 3/041

FOREIGN PATENT DOCUMENTS

WO 2013/083636 A1 6/2013
WO 2013/127810 A1 9/2013
WO WO 2013127810 A1 * 9/2013 ..... A24D 3/041

OTHER PUBLICATIONS

Written Opinion dated Feb. 3, 2015 issued in corresponding PCT/EP2014/071453 application (pp. 1-6).

* cited by examiner

AEROSOL TRANSFERRING ADAPTER FOR AN AEROSOL GENERATING DEVICE AND METHOD FOR TRANSFERRING AEROSOL WITHIN AN AEROSOL GENERATING DEVICE

FIELD OF THE INVENTION

The present invention pertains to an aerosol transferring adapter for an aerosol generating device, an aerosol generating device comprising such an aerosol transferring adapter and a method for transferring aerosol within an aerosol generating device, in particular for use with refillable electronic cigarettes or vaporizers.

BACKGROUND OF THE INVENTION

Conventional electrically operated cigarettes, so-called "e-cigarettes", usually include a heater powered by an electrical power source and a liquid reservoir containing flavoured liquid that can be volatilized using the heater and transferred to a user of the e-cigarette in an airflow through a mouthpiece of the e-cigarette.

Such an electrically operated cigarette is for example known from the document US 2013/0160764 A1.

With existing e-cigarettes it is possible for a user to choose one specific flavoured liquid to produce a corresponding flavoured aerosol at a time. It is unfortunately not possible for the user to choose, with one same e-cigarette, between several different flavoured liquids and produce several different flavoured aerosols among which he can choose prior or during use according to his taste and mood. To be able to change the aerosol flavour he enjoys the user needs to change the aerosol generating liquid in his device, which is quite cumbersome and unhygienic due to potential risks of leakage of the liquid in and out of the device and the liquid reservoir/cartridge holding it.

SUMMARY OF THE INVENTION

It is therefore one object of the present invention to provide disposable or reusable mouthpieces for aerosol generating devices which enable a user of the aerosol generating devices to flexibly adjust the taste profile and properties of the inhaled aerosol.

This problem is solved by a mouthpiece for an aerosol generating device having the technical features of claim 1, an aerosol transferring adapter having the technical features of claim 7, an aerosol generating device having the technical features of claim 12, and a method for transferring aerosol within an aerosol generating device having the technical features of claim 15.

According to a first aspect of the present invention, a mouthpiece comprises at least two mouthpiece compartments being fluidly separated from each other and each leading from at least one mouthpiece inlet to at least one mouthpiece outlet, and a mouthpiece fitting arranged around the mouthpiece inlet and configured to be alignably connected to an aerosol generating device.

According to a second aspect of the present invention, an aerosol transferring adapter for an aerosol generating device comprises a liquid storage component (for example, absorbent plastic mesh, or storage tank) and a mouthpiece according to the first aspect of the invention.

The liquid storage component comprises a liquid reservoir for holding a liquid used to generate an aerosol, at least one airflow channel leading through the liquid reservoir, and a connector fitting arranged around the airflow channel. The mouthpiece fitting is configured to be alignably connected to the connector fitting of the liquid storage component.

According to a third aspect of the present invention, an aerosol generating device, comprising an aerosol transferring adapter according to the second aspect, and a heating element coupled to the liquid reservoir at a liquid interface and configured to heat liquid in the liquid reservoir, thereby generating aerosol in the airflow channel.

According to a fourth aspect of the present invention, a method for transferring aerosol within an aerosol generating device comprises the following steps: generating aerosol by volatilizing compounds of a liquid composition in a liquid reservoir of the aerosol generating device; guiding the generated aerosol to a mouthpiece of the aerosol generating device, the mouthpiece comprising at least two mouthpiece compartments being fluidly separated from each other and each leading from a mouthpiece inlet to a mouthpiece outlet; aligning the position of the mouthpiece with respect to the liquid reservoir; and guiding the generated aerosol through at least one of the mouthpiece compartments depending on the aligned position of the mouthpiece with respect to the liquid reservoir (or area that electronic cigarette is attached to.)

EMBODIMENTS OF THE INVENTION

One main idea of the present invention is to provide a disposable mouthpiece component for an aerosol generating device that can be connected to the aerosol generating device and at the same time be aligned in different positions with respect to the main body of the aerosol generating device in order to align different flow-through channels of the mouthpiece component with an outlet of the aerosol generating device.

One advantage of such component is the possibility to modify properties of the airflow with the aerosol of the aerosol generating device through the mouthpiece component by virtue of varying properties of the respectively aligned flow-through channel without having to change the aerosol generating device itself. A user can select and adjust the aerosol taste, flow-through rate or other properties for example by twisting or mechanically adjusting the connecting position of the mouthpiece component with respect to the aerosol generating device. Particularly advantageous is the fact that varying aerosol modification tools such as filtration materials, tobacco or tobacco derivatives, flavour matrices or moisture pads may be incorporated in the mouthpiece component without the need to alter the aerosol generating device.

Especially for flavours, it is advantageous that the flavours in the mouthpiece component are more stable since they neither get into contact with other ingredients used to produce the aerosol, for example the source liquid, nor do they need to be directly heated. This prevents the formation of unwanted pyrolysis materials, prevents the deposition of non-volatile components of natural flavours on the heating element and helps prolonging the flavour generating properties of the mouthpiece component.

Inclusion of tobacco or tobacco derivatives as an aerosol modification component can help with improvement of the taste and sensory characteristics of the aerosol generating device, such that the characteristics become more similar to those of traditional combustible tobacco products.

Filtration materials may also be used for the mouthpiece component in order to remove the amount of visible smoke emitted from the aerosol generating device or to remove undesirable components, particles or residues.

The dependent claims provide additional technical features of advantageous embodiments and further improvements of the invention.

According to an embodiment of the aerosol transferring adapter, the aerosol transferring adapter further comprises at least one sealing ring fitted between the connector fitting and the mouthpiece fitting fluidly sealing the interface between the liquid storage component and the mouthpiece against the environment. Thereby, unwanted in flowing air or particles from outside may be blocked out, so that the aerosol altering properties of the mouthpiece compartments may be as predictable and stable as possible.

According to a further embodiment of the aerosol transferring adapter, the connector fitting and the mouthpiece fitting realize complementary snap-fit parts or interlocking clearances. This has the advantage, that the liquid storage component and the mouthpiece may be connected in a manner that is very difficult to reverse without breaking the adapter. Therefore, contact with substances in the liquid reservoir as well as undesired user initiated manipulations to the adapter may be avoided.

According to a further embodiment of the aerosol transferring adapter, at least one of the at least two mouthpiece compartments comprises an aerosol modifying medium arranged therein. According to one possibility, the aerosol modifying medium may comprise a flavourant, tobacco, tobacco derivative(s) or a combination thereof. Alternatively or additionally, the aerosol modifying medium may comprise a filtration material. Further alternatively or additionally, the aerosol modifying medium may comprise a moisturizing/drying pad.

Further alternatively or additionally, the aerosol modifying medium may comprise tobacco or a tobacco derivative. Characteristics of the tobacco or tobacco derivative, such as moisture, pH value or particle size distribution, can be altered to enable control of the aerosol taste and sensory characteristics. For example, a smaller average particle size may permit better release of tobacco flavour components by increasing the surface area. However, smaller particles may also cause an increase in pressure drop through the tobacco medium.

The mouthpiece may be filled with varying aerosol modifying mediums for different purposes, thereby enhancing the flexibility in using the aerosol generating device without the need to alter its general functionality or having to use different aerosol generating devices.

According to a further embodiment of the aerosol transferring adapter, at least two of the mouthpiece compartments comprise different aerosol modifying mediums arranged therein. This has the advantage that a user may easily and flexibly change the properties of the generated aerosol during use of the aerosol generating device.

According to a further embodiment of the aerosol transferring adapter, the mouthpiece is rotatable against the liquid storage component, the rotation causing the airflow channel to connect to a different compartment of the at least two of the mouthpiece compartments depending on the rotation position of the mouthpiece. Especially for rotation, in the case of symmetrically constructed aerosol generating devices and corresponding aerosol transferring adapters, this alignment procedure allows for easy, comfortable and reliable handling without altering the outer shape of the device overall.

According to a further embodiment of the aerosol transferring adapter, the aerosol transferring adapter comprises one or more alignment marks in the outer housing of the mouthpiece and/or the liquid storage component configured to indicate the rotation position of the mouthpiece to a user of the aerosol generating device. Such alignment marks may be signs, colour coded marks or similar visual indicators.

Alternatively or additionally, locking, snapping or latching marks using recesses, clearances and/or tappets may be provided giving the user auditory or tactile feedback upon alignment of the mouthpiece.

According to an embodiment of the aerosol generating device, the aerosol generating device may further comprise an electrical power source coupled to the heating element and configured to provide the heating element with electrical energy.

According to a further embodiment of the aerosol generating device, the aerosol generating device may further comprise a housing enclosing at least the heating element and the electrical power source.

According to an embodiment of the method of the third aspect of the invention, the step(s) of guiding the generated aerosol comprises an inhaling action of a user of the aerosol generating device through the mouthpiece outlet.

The invention will be explained in greater detail with reference to exemplary embodiments depicted in the drawings as appended.

BRIEF DESCRIPTION OF THE DRAWINGS

The accompanying drawings are included to provide a further understanding of the present invention and are incorporated in and constitute a part of this specification.

The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

DETAILED DESCRIPTION OF THE EMBODIMENTS

Although specific embodiments have been illustrated and described herein, it will be appreciated by those of ordinary skill in the art that a variety of alternate and/or equivalent implementations may be substituted for the specific embodiments shown and described without departing from the scope of the present invention.

Generally, this application is intended to cover any adaptations or variations of the specific embodiments discussed herein. In the present invention, reference is made to aerosol generators. Such aerosol generators or aerosol generating device are generally intended to comprise any apparatus capable of converting electric energy and/or combustion energy into heat and subsequently heating and thereby volatilizing particles in a vaporisable material, for example, a liquid composition contained within a part of the aerosol generating device. Aerosol generating devices within the meaning of the present invention may transport the volatilized particles in an airflow through the aerosol generating device to a user of the device, the user of the device being able to activate or deactivate the generation of aerosol and to control the duration, velocity and volume of the airflow by means of puffing or inhaling action.

Figure 1:
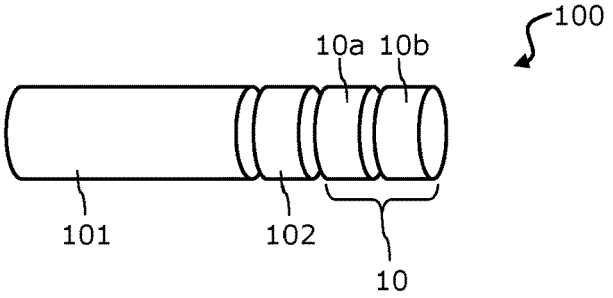
FIG. 1 schematically illustrates a concept of an aerosol generating device according to an embodiment of the invention.

FIG. 1 schematically illustrates a concept of an aerosol generating device 100. The aerosol generating device 100 may generally comprise a power source 101, such as an electrical power source, for example a battery or an accumulator. The power source 101 is generally operatively coupled to a heating element 102, the heating element being supplied with energy for its operation by the power source 101. The power source 101 and the heating element 102 may be part of a basis of the aerosol generating device 100. The aerosol generating device 100 may further comprise electronic circuitry controlling the operation of the aerosol generating device 100 and/or various buttons or light emitting elements on its outer surface, all of which are not shown in FIG. 1 for purposes of improved clarity of the drawings.

The aerosol generating device 100 may comprise an aerosol transferring adapter 10 which may consist of two separable components 10*a* and 10*b*. The component 10*a* may be a liquid storage component which may be coupled to the heating element 102 in operative connection, so that the heating element 102 may supply heating energy to a liquid contained with the liquid storage component 10*a*, thereby causing certain compounds contained in the liquid to volatilize into an airflow streaming through the liquid storage component 10*a*. The liquid storage component 10*a* may be operatively coupled to a mouthpiece 10*b* in order to guide the generated aerosol in the liquid storage component 10*a* through the mouthpiece 10*b* towards a user of the aerosol generating device 100.

The overall arrangement of the power source 101, the heating element 102 and the aerosol transferring adapter 10 may deviate from the conceptual illustration in FIG. 1 and may be adapted to the design and purpose of the aerosol generating device 100. It may for example be possible to implement electrical connections between the aerosol generating device 100 and the aerosol transferring adapter 10 enabling control circuitry within the aerosol generating device 100 to gather information regarding the operational state of the aerosol transferring adapter 10.

Figure 2:
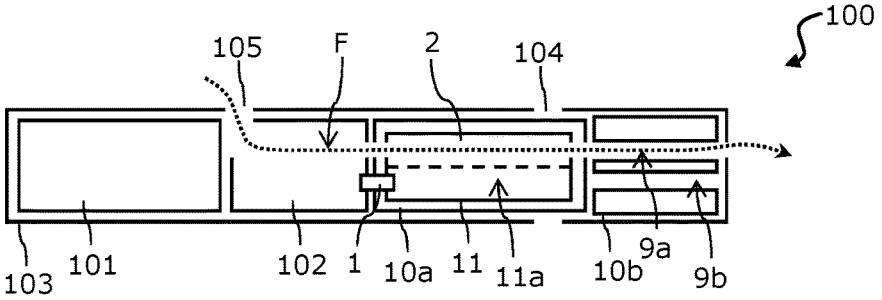
FIG. 2 schematically illustrates a functional depiction of an aerosol generating device according to a further embodiment of the invention.

FIG. 2 shows a schematic illustration of a functional depiction of an aerosol generating device 100. The aerosol generating device 100 may again comprise a power source 101 and a heating element 102 as explained in conjunction with FIG. 1.

The power source 101 and the heating element 102 may for example be enclosed in a housing 103 having an inlet 105 in the general vicinity of the heating element 102 in order to have air stream F flow through or along the heating element 102 towards the liquid storage component 10*a*. The liquid storage component 10*a* may comprise a liquid reservoir 11 in which a liquid composition 11*a* with compounds to be volatilized may be contained. The liquid reservoir 11 may be in connection with the heating element 102 by means of a liquid interface 1 which may convey heating energy to the liquid 11*a*, thereby evaporating or volatilizing certain compounds of the liquid 11*a*. The air stream or airflow F may enter the liquid reservoir 11, flow through an airflow channel 2 leading through the liquid reservoir 11 over or near the liquid 11*a* and absorb the volatilized or evaporated particles, thus creating an aerosol in the liquid reservoir 11.

The generated aerosol may then be transported in the airflow F to the mouthpiece 10*b*. The mouthpiece 10*b* may comprise at least two mouthpiece compartments 9*a*, 9*b* being fluidly separated from each other and each leading from a mouthpiece inlet to a mouthpiece outlet, the mouthpiece inlet being in fluid communication with the airflow channel 2 and the mouthpiece outlet being on the far end of the liquid storage component 10*a*. At the mouthpiece outlet, the aerosol guided through the mouthpiece 10*b* may be inhaled by a user of the aerosol generating device 100. The number of mouthpiece compartments 9*a*, 9*b* is not limited to two, but may be any suitable number as well.

The different mouthpiece compartments 9*a*, 9*b* may be used to modify or alter the properties of the aerosol being guided through the mouthpiece 10*b*. For example, one or more of the mouthpiece compartments 9*a*, 9*b* may be equipped with an aerosol modifying medium arranged therein. Such aerosol modifying mediums may for example comprise flavourants, for example flavourants adsorbed onto solid matrices, encapsulated flavourants, surface coated flavourant particles, tobacco, tobacco derivatives or similar materials. It may of course also be possible to include combinations of the aforementioned materials in the aerosol modifying mediums.

It may also be possible for the aerosol modifying medium to comprise a filtration material. The filtration material may for example be used to reduce the amount of visible aerosol or to remove unwanted particles or components from the airflow to the user. The aerosol modifying medium may also be used to change aerosol characteristics such as moisture, pH value, particle size or the like, for example in order to mimic the taste of traditional tobacco products as well as possible.

The aerosol modifying medium may for this purpose for example comprise a moisturizing/drying pad, a pH changing material or sieve means.

While the number, placement and amount of aerosol modifying mediums in the mouthpiece compartments 9*a*, 9*b* may vary, it may be preferred to equip at least two of the mouthpiece compartments 9*a*, 9*b* with different aerosol modifying mediums arranged therein. Depending on the compartment 9*a*, 9*b* through which the airflow F will stream, different modifiers might be used on the aerosol, thereby generating different inhaling experiences for the user. For example, it may be possible to have one of the mouthpiece compartments 9*a*, 9*b* equipped with a flavourant, while another of the mouthpiece compartments 9*a*, 9*b* may be left blank. In such case, by aligning the mouthpiece 10*b* with respect to the liquid storage component 10*a*, the airflow F may be selectively directed towards one of the two mouthpiece compartments 9*a*, 9*b*, thus allowing perfect control of the flavour and intensity of the modified aerosol. The mouthpiece compartments 9*a*, 9*b* can also be subdivided further, to facilitate the positioning and securing of the aerosol modification medium within the mouth piece compartments 9*a*, 9*b*.

The housing 103 may be interrupted by gripping recesses 104 so that the user is able to more easily create a torque between the liquid storage component 10*a* and the mouthpiece 10*b* in order to align the mouthpiece 10*b* in a desired position. Alternatively or additionally, the housing may have alignment notches or grooves fitting the liquid storage component 10*b*, thereby stopping undesired concomitant rotation of the liquid storage component 10*b* with the mouthpiece 10*a* inherently by design.

Figure 3:
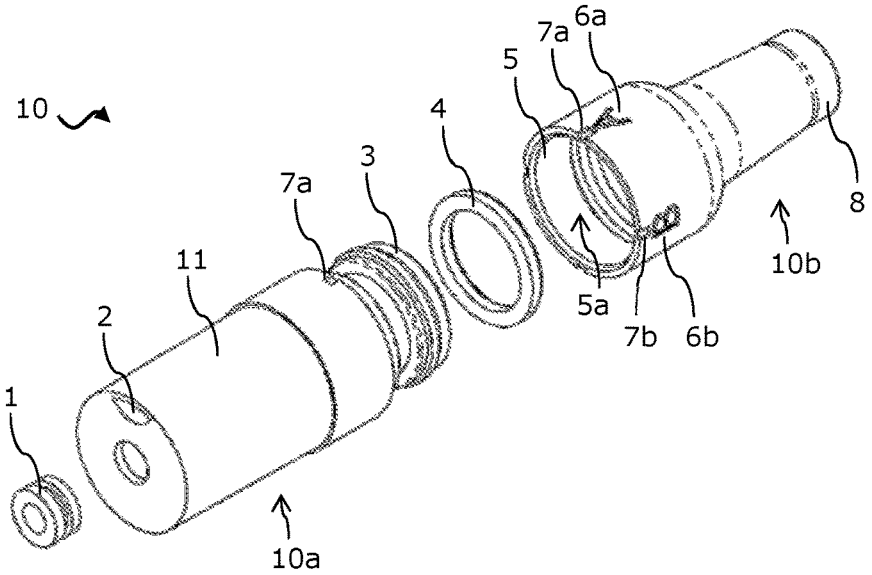
FIG. 3 schematically illustrates a perspective enlargement view of an aerosol transferring adapter according to yet another embodiment of the invention.
Figure 4:
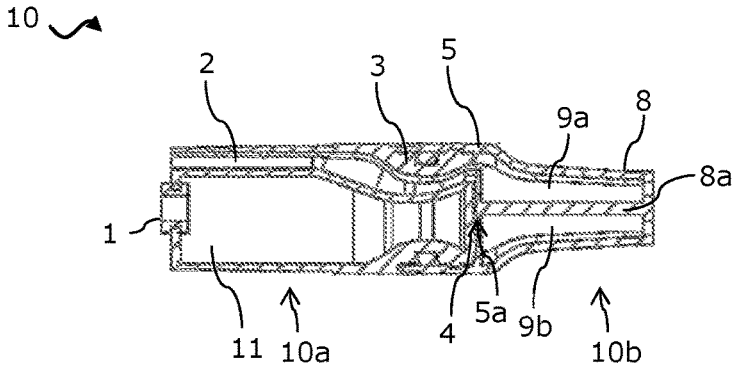
FIG. 4 schematically illustrates a cross-sectional view of an aerosol transferring adapter according to yet another embodiment of the invention.
Figure 5:
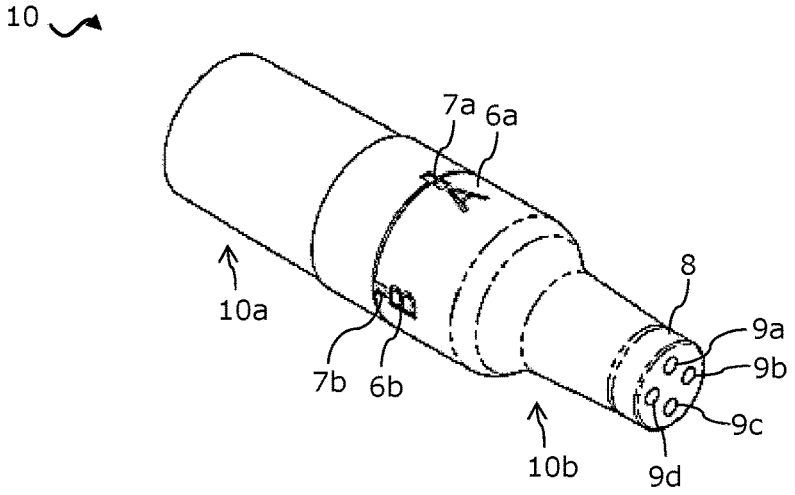
FIG. 5 schematically illustrates a perspective view of an aerosol transferring adapter according to yet another embodiment of the invention.

FIGS. 3 to 5 show schematic illustrations of an aerosol transferring adapter 10 in greater detail. The aerosol transferring adapter 10 of FIG. 3 may for example be used for an aerosol generating device as shown and explained in FIGS. 1 and 2.

The aerosol transferring adapter 10 comprises the liquid storage component 10*a* and a mouthpiece 10*b*. The liquid storage component comprises a liquid reservoir 11 for holding a liquid used to generate an aerosol. An airflow channel 2 leads through the liquid reservoir 11, and the liquid reservoir 11 may be connected to a heating element 102 of an aerosol generating device 100 by means of a liquid interface 1, for example a plastic or metal grommet.

The liquid storage component 10*a* also comprises a connector fitting 3 arranged around the airflow channel 2. Correspondingly, the mouthpiece 10*b* comprises a mouthpiece fitting 5 arranged around a mouthpiece inlet 5*a* and configured to be alignably connected to the connector fitting 3 of the liquid storage component 10*a*. The connector fitting 3 and the mouthpiece fitting 5 may be constructed in a complementary and corresponding manner, for example by a moulding procedure, to realize complementary snap-fit parts or interlocking clearances. For example, the mouthpiece fitting 5 may include protrusions that interlock with recesses in the connector fitting 3 when edging the tubular connector fitting 3 into the mouthpiece fitting 5.

Between the connector fitting 3 and the mouthpiece fitting 5 a sealing ring 4, for example a rubber O-ring or similar, may be fitted thereby fluidly sealing the interface between the liquid storage component 10*a* and the mouthpiece 10*b* against the environment.

The mouthpiece 10*b* may be manufactured as essentially cylindrical to be rotatable against the liquid storage component 10*a*, the rotation causing the airflow channel 2, which may be arranged off-centre in the liquid reservoir 11, to connect to a different compartment of the at least two of the mouthpiece compartments 9*a*, 9*b*, 9*c*, 9*d* depending on the rotation position of the mouthpiece 10*b*. The rotation position of the mouthpiece 10*b* may be indicated to a user of the aerosol generating device by one or more alignment marks 7*a*, 7*b* in the outer housing of the mouthpiece 10*b* and/or the liquid storage component 10*a*. The alignment marks 7*a*, 7*b* may for example be visual marks like colour codes or sign labels. Alternatively or additionally, the alignment marks 7*a*, 7*b* may be haptic marks like indentations, grooves, notches or bumps on the respective components to provide a tactile response to a user touching the alignment marks 7*a*, 7*b*. It may also be possible to arrange the alignment marks 7*a*, 7*b* to generate noise or sound, like clicks or snaps as audible confirmation of the rotation position of the mouthpiece 10*b*. Additionally, sign labels or operational mode indicators 6*a*, 6*b* may be arrange on the housing of the mouthpiece 10*b* and/or the liquid storage component 10*a* as well.

Additionally, the position of the rotatable mouthpiece 10*b* may be communicated to an electronic control circuit of the aerosol generating device 100, such that aerosol generating device 100 functionality can be modified to optimise performance with that particular flavour. For example, the colour of the light emitted during puffing could be matched with the flavour in use, such as the colour green for menthol flavour, or the heating profile of the heating element 102 could be altered to suit the chemical composition of the flavour.

FIG. 4 shows a schematic illustration of a cross-sectional view of the aerosol transferring adapter 10 in FIG. 3. The mouthpiece compartments 9*a*, 9*b* of the mouthpiece 10*b* are arranged at a circumference around a centre partitioning element 8*a*, like a moulded wall. As shown in FIG. 4, the airflow channel 2 through the liquid reservoir 11 is designed to lie off-centre of the liquid reservoir 11. This configuration helps in ensuring proper and effective alignment of the mouthpiece compartments 9*a*, 9*b* with the airflow channel 2 upon rotation of the mouthpiece 10*b*. Depending on the tightness of the seal between the connector fitting 3 and the mouthpiece fitting 5 as well as on the distance between the partitioning element 8*a* and the wall of the liquid reservoir 11, the portion of the airflow F being guided from the airflow channel 2 through the respectively aligned mouthpiece compartment 9*a*, 9*b* will vary. For example, if the partitioning element 8*a* completely seals off the remaining momentarily non-aligned mouthpiece compartments from the airflow channel 2, all the aerosol generated in the liquid reservoir 11 will flow through momentarily the aligned mouthpiece compartment (compartment 9*a* in the position shown in FIG. 3, as an example).

When rotating the mouthpiece 10*b* by 180° with respect to the liquid reservoir 11, the respectively other mouthpiece compartment (compartment 9*b* in the position shown in FIG. 3, as an example) will align with the airflow channel 2. This means that a user is able to use different mouthpiece compartments 9*a*, 9*b* for transferring the aerosol from the liquid reservoir 11 to his mouth. Depending on the properties of the aerosol modifying mediums in the different mouthpiece compartments 9*a*, 9*b* the user is able to easily change flavour type, flavour intensity, particle size, moisture or other properties of the airflow F to be inhaled.

FIG. 5 shows another perspective view of the aerosol transferring adapter 10 in assembled state. The alignment marks 7*a*, 7*b* are in congruence with each other, with the mouthpiece 10*b* being rotated into operational state "A", as exemplarily indicated by the alignment indicators 6*a* (and/or 6*b*). The exemplary aerosol transferring adapter 10 of FIG. 5 is equipped with four mouthpiece compartments 9*a*, 9*b*, 9*c*, 9*d* having the outlet at the mouthpiece outlet 8.

Figure 6:
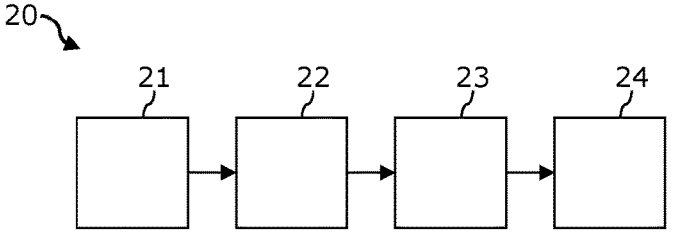
FIG. 6 schematically illustrates a method for transferring aerosol within an aerosol generating device according to yet another embodiment of the invention.

FIG. 6 schematically illustrates a method 20 for transferring aerosol within an aerosol generating device, such as the aerosol generating device 100 of FIGS. 1 and 2. The method may make use of an aerosol transferring adapter, for example an aerosol transferring adapter 10 as shown and described in conjunction with FIGS. 3 to 5. The method 20 may comprise as first step generating aerosol 21 by volatilizing compounds of a liquid composition in a liquid reservoir of the aerosol generating device. The generated aerosol is then guided in a second step 22 to a mouthpiece of the aerosol generating device, the mouthpiece comprising at least two mouthpiece compartments being fluidly separated from each other and each leading from a mouthpiece inlet to a mouthpiece outlet.

In a third step 23 the position of the mouthpiece 10*b* is aligned with respect to the liquid reservoir, so that in a fourth step 24 the generated aerosol may be guided through at least one of the mouthpiece compartments depending on the aligned position of the mouthpiece with respect to the liquid reservoir. Guiding the aerosol may in each case be effected by an inhaling action of a user of the aerosol generating device through the mouthpiece outlet.

In the foregoing detailed description, various features are grouped together in one or more examples or examples with the purpose of streamlining the disclosure. It is to be understood that the above description is intended to be illustrative, and not restrictive. It is intended to cover all alternatives, modifications and equivalents. Many other examples will be apparent to one skilled in the art upon reviewing the above specification.

The embodiments were chosen and described in order to best explain the principles of the invention and its practical applications, to thereby enable others skilled in the art to best utilize the invention and various embodiments with various modifications as are suited to the particular use contemplated. In the appended claims and throughout the specification, the terms "including" and "in which" are used as the plain-English equivalents of the respective terms "comprising" and "wherein," respectively. Furthermore, the terms "a" and an used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects. Terminology used hereinabove to specify geometric or spatial orientation such as "left", "right", "top", "bottom", "side", "front", "back" and the like is not intended to impose any specific limitation as to the orientation of the objects denoted but rather serve to more easily identify the respective features in the drawings.

LIST OF REFERENCE SIGNS

1 Liquid interface
2 Airflow channel
3 Connector fitting
4 Sealing ring
5 Mouthpiece fitting
5*a* Mouthpiece inlet
6*a* Alignment indicator
6*b* Alignment indicator
7*a* Alignment mark
7*b* Alignment mark
8 Mouthpiece outlet
8*a* Partitioning element
9*a* Mouthpiece compartment
9*b* Mouthpiece compartment
9*c* Mouthpiece compartment
9*d* Mouthpiece compartment
10 Aerosol transferring adapter
10*a* Liquid storage component
10*b* Mouthpiece
11 Liquid reservoir
11*a* Liquid
20 Method
21 Method step
22 Method step
23 Method step
24 Method step
100 Aerosol generating device
101 Power source
102 Heating element
103 Housing
104 Gripping recess
105 Air inlet
F Airflow

The invention claimed is:

1. A mouthpiece (10*b*) for an aerosol generating device (100), comprising:

at least two mouthpiece compartments (9*a*; 9*b*; 9*c*; 9*d*) being fluidly separated from each other and each leading from at least one mouthpiece inlet (5*a*) to at least one mouthpiece outlet (8), and a mouthpiece fitting (5) arranged around the mouthpiece inlet (5*a*), which mouthpiece fitting (5) is configured to be alignably connected to an aerosol generating device (100), wherein at least one of the at least two mouthpiece compartments is provided with a flavorant, and wherein the mouthpiece is alignable to selectively direct an airflow towards one of the two mouthpiece compartments in order to control a flavor of the aerosol.

2. The mouthpiece (10*b*) according to claim 1, wherein at least one of the at least two mouthpiece compartments (9*a*; 9*b*; 9*c*; 9*d*) comprises an aerosol modifying medium arranged therein.

3. The mouthpiece (10*b*) according to claim 2, wherein the aerosol modifying medium comprises a flavourant, tobacco, tobacco derivative(s) or a combination thereof.

4. The mouthpiece (10*b*) according to claim 2, wherein the aerosol modifying medium comprises a filtration material.

5. The mouthpiece (10*b*) according to claim 2, wherein the aerosol modifying medium comprises a moisturizing/drying pad.

6. The mouthpiece (10*b*) according to claim 2, wherein at least two of the mouthpiece compartments (9*a*; 9*b*; 9*c*; 9*d*) comprise different aerosol modifying mediums arranged therein.

7. An aerosol transferring adapter (10) for an aerosol generating device (100), comprising:

a liquid storage component (10*a*) comprising:

a liquid reservoir (11) for holding a liquid (11*a*) used to generate an aerosol, an airflow channel (2) leading from the liquid reservoir (11), and a connector fitting (3) arranged around the airflow channel (2); and a mouthpiece (10*b*) according to claim 1, the mouthpiece fitting (5) being configured to be alignably connected to the connector fitting (3) of the liquid storage component (10*a*).

8. The aerosol transferring adapter (10) according to claim 7, further comprising:

at least one sealing ring (4) fitted between the connector fitting (3) and the mouthpiece fitting (5) fluidly sealing the interface between the liquid storage component (10*a*) and the mouthpiece (10*b*) against the environment.

9. The aerosol transferring adapter (10) according to claim 7, wherein the connector fitting (3) and the mouthpiece fitting (5) realize complementary snap-fit parts or interlocking clearances.

10. The aerosol transferring adapter (10) according to claim 7, wherein the mouthpiece (10*b*) is rotatable against the liquid storage component (10*a*), the rotation causing the airflow channel (2) to connect to a different compartment of the at least two mouthpiece compartments (9*a*; 9*b*; 9*c*; 9*d*) depending on the rotation position of the mouthpiece (10*b*).

11. The aerosol transferring adapter (10) according to claim 10, further comprising:

one or more alignment marks (7*a*; 7*b*) in the outer housing of the mouthpiece (10*b*) and/or the liquid storage component (10*a*) configured to indicate the rotation position of the mouthpiece (10*b*) to a user of the aerosol generating device (100).

12. An aerosol generating device (100), comprising:

an aerosol transferring adapter (10) according to claim 7; and a heating element (102) coupled to the liquid reservoir (11) at a liquid interface (1) and configured to heat liquid (11*a*) in the liquid reservoir (11), thereby generating aerosol in the airflow channel (2).

13. The aerosol generating device (100) according to claim 12, further comprising:

an electrical power source (101) coupled to the heating element (102) and configured to provide the heating element (102) with electrical energy.

14. The aerosol generating device (100) according to claim 13, further comprising:

a housing (103) enclosing at least the heating element (102) and the electrical power source (101).

15. A method (20) for transferring aerosol within an aerosol generating device (100) according to claim 1, the method comprising the steps of:

generating (21) aerosol by volatilizing compounds of a liquid composition in a liquid reservoir (11) of the aerosol generating device (100);

guiding (22) the generated aerosol to a mouthpiece (10*b*) of the aerosol generating device (100), the mouthpiece (10*b*) comprising at least two mouthpiece compartments (9*a*; 9*b*; 9*c*; 9*d*) being fluidly separated from each other and each leading from a mouthpiece inlet (5*a*) to a mouthpiece outlet;

aligning (23) the position of the mouthpiece (10*b*) with respect to the liquid reservoir (11); and guiding (24) the generated aerosol through at least one of the mouthpiece compartments (9*a*; 9*b*; 9*c*; 9*d*) depending on the aligned position of the mouthpiece (10*b*) with respect to the liquid reservoir (11).

* * * * *